US011641903B2

(12) United States Patent
De Harde

(10) Patent No.: US 11,641,903 B2
(45) Date of Patent: May 9, 2023

(54) HELMET

(71) Applicant: Barend Hendrik De Harde, Johannesburg (ZA)

(72) Inventor: Barend Hendrik De Harde, Johannesburg (ZA)

( * ) Notice: Subject to any disclaimer, the term of this patent is extended or adjusted under 35 U.S.C. 154(b) by 262 days.

(21) Appl. No.: 16/763,423

(22) PCT Filed: Nov. 12, 2018

(86) PCT No.: PCT/ZA2018/050058
§ 371 (c)(1),
(2) Date: May 12, 2020

(87) PCT Pub. No.: WO2019/094992
PCT Pub. Date: May 16, 2019

(65) Prior Publication Data

US 2021/0068489 A1 Mar. 11, 2021

(30) Foreign Application Priority Data

Nov. 13, 2017 (ZA) ..... 2017/07481

(51) Int. Cl.
*A42B 3/06* (2006.01)
*A42B 3/20* (2006.01)

(52) U.S. Cl.
CPC ..... *A42B 3/062* (2013.01); *A42B 3/20* (2013.01)

(58) Field of Classification Search
CPC ..... A42B 3/06; A42B 3/063; A42B 3/064; A42B 3/062; A42B 3/30; A42B 3/18; A42B 3/14
See application file for complete search history.

(56) References Cited

U.S. PATENT DOCUMENTS 2,410,256 A * 10/1946 Anderson ..... A61F 9/061 D29/110
3,585,638 A * 6/1971 Aileo ..... A42B 3/228 2/6.4
3,727,235 A * 4/1973 Fisher ..... A42B 3/222 2/10
4,326,303 A * 4/1982 Rappleyea ..... A42B 3/08 2/425
4,837,866 A * 6/1989 Rector ..... A42B 3/20 2/424
5,095,552 A * 3/1992 Parkinson ..... A42B 3/20 2/9
5,263,204 A * 11/1993 Butsch ..... A42B 3/326 2/9
5,412,814 A * 5/1995 Pernicka ..... A42B 3/221 2/424
5,956,777 A 9/1999 Popovich
(Continued)

OTHER PUBLICATIONS

International Search Report from PCT/ZA2018/050058 dated Jan. 23, 2019, 5 pgs.

*Primary Examiner* — Bao-Thieu L Nguyen
(74) *Attorney, Agent, or Firm* — Tutunjian & Bitetto, P.C.

(57) ABSTRACT

A helmet which includes a helmet shell, a protective shield, and at least first and second fastener arrangement which respectively secure the protective shield to opposed sides of the helmet shell, and wherein each fastener arrangement includes a shock absorbing element which is engaged with and secured to a respective section of the protective shield.

13 Claims, 8 Drawing Sheets

(56) References Cited

U.S. PATENT DOCUMENTS 5,966,744 A * 10/1999 Smith, Jr. ..... A42B 3/20 2/9
5,978,973 A * 11/1999 Chartrand ..... A42B 3/20 2/424
6,047,409 A * 4/2000 Simpson ..... A42B 3/223 2/424
6,079,053 A * 6/2000 Clover, Jr. ..... A42B 3/20 2/9
6,301,719 B1 * 10/2001 Goodhand ..... A42B 3/20 24/324
6,385,781 B1 * 5/2002 Rose ..... A63B 71/1291 2/468
6,934,971 B2 * 8/2005 Ide ..... A42B 3/08 2/9
7,146,652 B2 * 12/2006 Ide ..... A42B 3/08 403/228
7,954,177 B2 * 6/2011 Ide ..... A42B 3/20
8,813,269 B2 * 8/2014 Bologna ..... A63B 71/081 2/6.2
8,899,867 B2 * 12/2014 Tatomir ..... A42B 3/20 403/168
9,072,332 B2 * 7/2015 De Harde ..... A42B 3/20
9,277,781 B2 * 3/2016 Hardy ..... A42B 3/222
9,788,591 B2 * 10/2017 Ide ..... A42B 3/20
10,856,600 B2 * 12/2020 Ide ..... F16B 21/12
11,006,689 B1 * 5/2021 Nowak ..... A42B 3/08
2008/0163410 A1 7/2008 Udelhofen
2012/0222198 A1 * 9/2012 Tatomir ..... A42B 3/18 2/424
2013/0312166 A1 * 11/2013 Hardy ..... A42B 3/20 2/424
2016/0360819 A1 * 12/2016 Summerville ..... A42B 3/20
2017/0042273 A1 2/2017 Fletcher et al.
2017/0056752 A1 3/2017 Tubbs
2017/0367427 A1 * 12/2017 Meade ..... A42B 3/127
2019/0014851 A1 * 1/2019 Tubbs ..... A63B 71/10

* cited by examiner

HELMET

BACKGROUND OF THE INVENTION

This invention relates to a helmet to protect the head or neck of a person wearing the helmet. The invention is hereinafter described with reference to the use of the helmet by a participant in a ball game, such as cricket, but such application is exemplary only and is non-limiting for the principles of the invention can be used in other protective headgear e.g. a riot head piece, a ski helmet and so on.

The specification of U.S. Pat. No. 9,072,332 describes a sports helmet which is worn to provide head protection against impact of a cricket ball, a baseball or the like. The specification describes the use of a grille arrangement which is attached to a helmet shell by means of attachment formations which are displaceably mounted to the helmet shell by means of shock absorbing mountings which are "doughnut-shaped" and which are located on the helmet shell. The size of each shock absorbing mounting is limited in that it is mounted on the helmet shell and, consequently, its capability of absorbing shock caused by a ball impacting on the grille is also restricted.

An object of the present invention is to address, at least to some extent, the aforementioned shortcoming.

SUMMARY OF THE INVENTION

The invention provides a helmet which includes a helmet shell, a protective shield, and at least first and second fastener arrangements which respectively secure the protective shield to opposing sides of the helmet shell. Each fastener arrangement includes a shock absorbing element engaged with and secured to the protective shield.

The shock absorbing element may comprise a body which is made from a resiliently deformable material.

The protective shield may be of any suitable form required for the application. For example, the protective shield may be made from a sheet material such as a toughened, transparent plastics material for a riot helmet or similar application or, for a sports helmet, from a suitably configured grille. The sheet material need not be continuous. It can be made from a plurality of sections. Also, the sheet material can include a plurality of apertures to allow for air circulation and sound transmission.

In the former example the sheet material may include at least one keying formation such as an aperture, a projection or an irregular surface in or on the sheet material and the shock absorbing element may be positioned to engage with the keying formation.

In the other example the protective grille may include a plurality of elongate members and a plurality of cross members which are secured to the elongate members to form a plurality of mesh apertures. In this instance the shock absorbing material may engage with one or more of at least one aperture, a part of at least one elongate member and a part of at least one cross member.

Each formation in the protective shell (sheet material or grille) used as a keying formation, normally calls for the shock absorbing element to have a complementary formation which is engageable therewith and which, depending on the circumstances, may also be considered to be a keying formation.

A portion of the shock absorbing element may be positioned between and in contact with at least first and second said elongate members which are spaced apart from each other. Preferably a portion of the shock absorbing element is positioned between and is in contact with at least first and second said cross members which are spaced apart from each other. Thus, the shock absorbing element may be positioned at least partly within at least one of the mesh apertures.

In a preferred embodiment a third cross member, which is located between said first and second cross members, is in contact with the shock absorbing element.

A periphery of the shock absorbing element may abut portions of those elongate members and cross members which bound or are adjacent the mesh aperture.

In one embodiment, the body of the shock absorbing element has grooves in which are respectively located one or more of the following: a portion of a first cross member, a portion of a second cross member, a portion of a first elongate member and a portion of a second elongate member.

Each said shock absorbing element may be positioned to overlie at least partly a respective ear of a person wearing the helmet and the shock absorbing element may be formed with at least one hole to allow for the transmission of sound to the ear.

Each fastener arrangement may respectively include a first component which is fixed to the helmet shell and a second component which is fixed to the first component, and possibly to the helmet shell as well, with at least a part of the shock absorbing element located between opposing surfaces of the first and second components.

Each component may comprise a respective plate, preferably a thin metallic plate.

The helmet may include a rear fastener arrangement which secures the protective shield to a rear end of the helmet shell and which includes a shock absorbing element which is engaged with and secured to a rear section of the protective shield.

Each fastener arrangement may respectively be secured to the helmet shell by means of at least one respective fastener which includes a resiliently deformable member.

The protective shield is preferably configured to be in the form of a closed loop structure which, in use, extends around a head of a user of the helmet but with the protective shield being spaced from the head and positioned spaced from, and, in use, below a lower edge of the helmet shell.

The closed loop structure holds at least two significant benefits. Firstly, physical protection against impact whether by a ball or other implement is provided on all sides of the head and neck by the shield and, secondly, the impact force on the shield is transmitted in a "circumferential" manner around the shield due to the closed loop structure. Each fastener arrangement is thus able to absorb a part of the impact force.

In another form of the invention the helmet comprises a helmet shell with opposed first and second sides, a front end, a rear end and a lower edge. A protective shield comprising a closed loop structure with a radial inner side, a radial outer side and keying formations in or on the shield. A plurality of fasteners secure the protective shield to the helmet shell with the protective shield and are spaced from the helmet shell. The plurality of fasteners comprise at least first and second side fastening arrangements which respectively secure the protective shield to said first and second sides of the helmet shell. Each fastener arrangement respectively includes first and second spaced apart components located respectively on said radial inner side of the closed loop structure and on said radial outer side of the closed loop structure, and at least one shock absorbing element which is engaged with at least one keying formation. The shock absorbing element is located at least partly between said first and second components, and at least one fixing member which is engaged with the first and second components and which urges the first and second components towards each other.

In one embodiment the protective shield is formed from a plurality of elongate members and a plurality of cross members respectively secured to the elongate members at spaced apart locations thereby forming a plurality of mesh apertures, and each shock absorbing element is located at least partly within a respective mesh aperture which is bounded by opposed portions of two elongate members and two opposed portions of two cross members. Such aperture, and the portions of the elongate and cross members, thus act as keying formations which engage with the shock absorbing element but in such a way that, under impact, at least a part of the element can deform in a shock absorbing manner.

The engagement of the keying formation with the shock absorbing element may be such that, effectively, there is no slip of the formation, relative to the element, under impact on the shield. The impact force is then absorbed by deformation of the element.

In another form of the invention the protective shield comprises sheet material which depending on the application may be transparent or apertured. The keying formations, e.g. protrusions or apertures or both may then be formed directly in the sheet material. Alternatively, suitably shaped members may be fixed to the sheet material in any suitable way or project therefrom to act as keying formations.

Each shock absorbing element may be sandwiched between opposing surfaces of the first and second components which are used to secure the shock absorbing element to the closed loop structure. The shock absorbing element is laminated between the first and second components and the resulting structure, although flexible and deformable to some extent, is strong and is able to withstand a direct impact by a high speed ball or implement. Thus, the protective shield protects the head and neck against impact, e.g. of a ball or implement, from any direction to the side of a person wearing the helmet.

Registering holes are positioned in the components and in the shock absorbing element so that in use sound can be transmitted through the registering holes to an ear of a person wearing the helmet.

The first component may comprise a first plate. The second component may comprise a second plate. Each component may be made from any suitable material e.g. a tough plastics material. Preferably each component comprises a plate made from a thin sheet of a suitable grade of steel. Each plate, although thin, is sufficiently strong to secure the protective shield to the helmet shell in the described manner. It is important that the protective shield should not add unduly to the mass of the helmet and for this reason lightweight parts are used where possible in the construction of the shield and to secure the shield to the helmet shell.

The shock absorbing element may comprise a body which is made from a resiliently deformable material such as polyurethane, rubber or the like. A suitable material is rubber with a Shore hardness which is less than 50. Preferably the Shore hardness is of the order of 20 to 30.

The shock absorbing element may be perforated or aerated to enhance its shock absorbing capabilities.

Each fixing member may extend through the shock absorbing element and may be located at a position which is spaced from a solid part of the shield by a part of the shock absorbing element so that the fixing member is mounted in a floating state in that it abuts the resiliently deformable shock absorbing element, and does not directly contact a solid part of the protective shield. Thus, when the shield is impacted a portion of the shock absorbing element can deform and so absorb at least some of the shock loading without directly transferring the impact shock to the shield.

BRIEF DESCRIPTION OF THE DRAWINGS

The invention is further described by way of examples with reference to the accompanying drawings in which.

DESCRIPTION OF PREFERRED EMBODIMENTS

Figure 1:
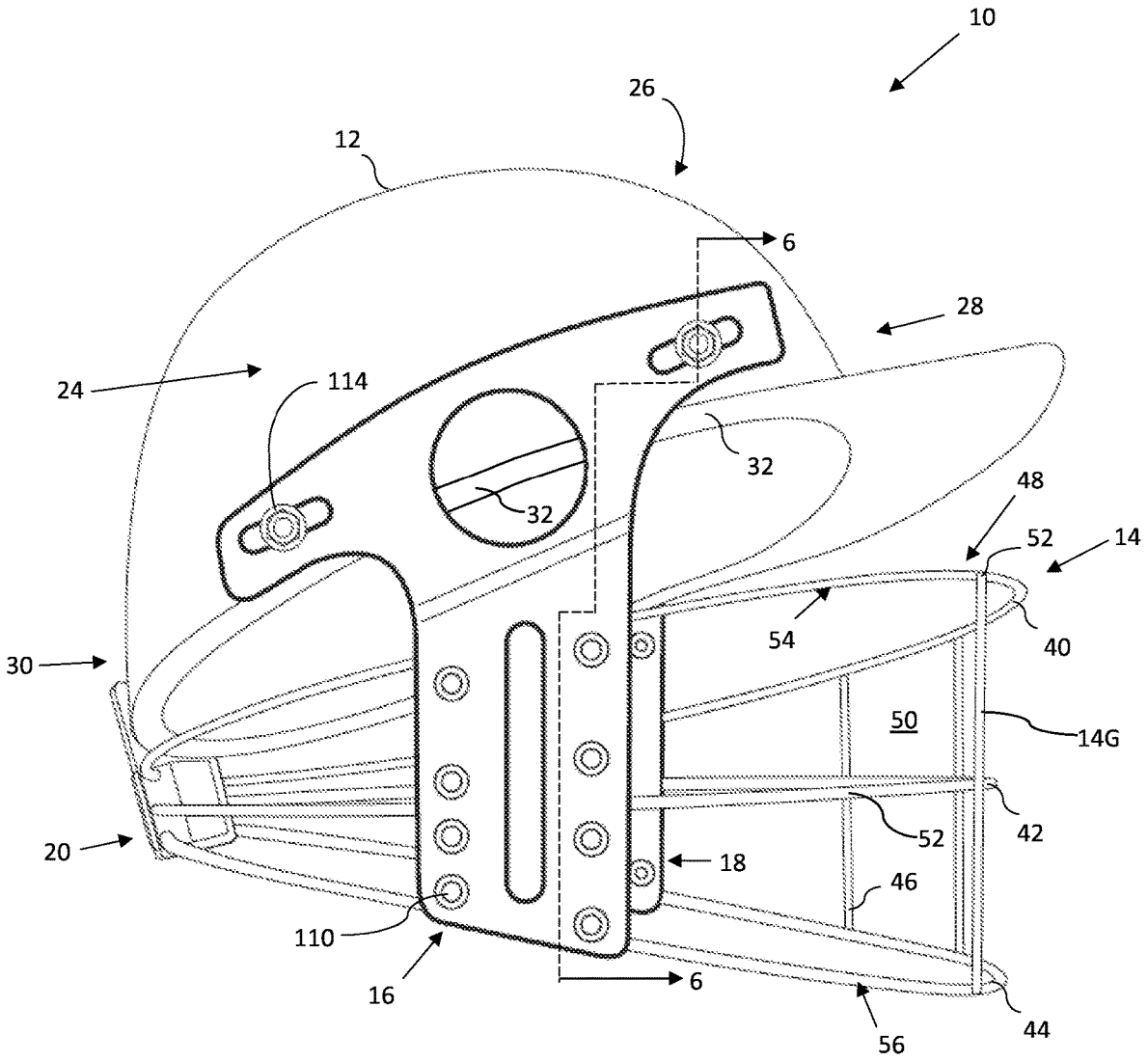
FIG. 1 is a side view of a helmet according to the invention.

FIG. 1 of the accompanying drawings is a side view of a helmet 10 according to one form of the invention. The helmet 10 includes a helmet shell 12, a protective shield 14 in the form of a protective grille 14G, two side fastening arrangements 16 and 18 respectively, and a rear fastening arrangement 20 which is shown in more detail in FIGS. 2 and 7.

Inside the helmet shell 12, but not shown in the drawings, is a shock absorbing layer which facilitates mounting of the helmet shell on the head of a user in a comfortable and shock absorbing manner. This aspect is not described further herein for in general terms it is known in the art.

The helmet shell 12, which is made from a suitable material such as fiber glass or another plastics composite material, has opposed first and second sides 24 and 26 respectively, a front end 28, a rear end 30 and a lower edge 32.

The protective grille 14G includes first, second and third elongate members 40, 42 and 44 respectively each of which, viewed in plan, roughly follows an oval path. The grille 14G further includes a number of cross members which are collectively designated 46. The cross members 46 are transverse to the elongate members 40 to 44 and are positioned at spaced locations to form a closed loop structure 48 with a plurality of mesh apertures 50. The cross members 46 are welded to the adjacent members 40 and 44 at respective points of contact 52.

The elongate members and the cross members, in exemplary and non-limiting form, are made from steel rods or the like.

The closed loop structure 48 has a radial inner side 54 and a radial outer side 56.

Figure 3:
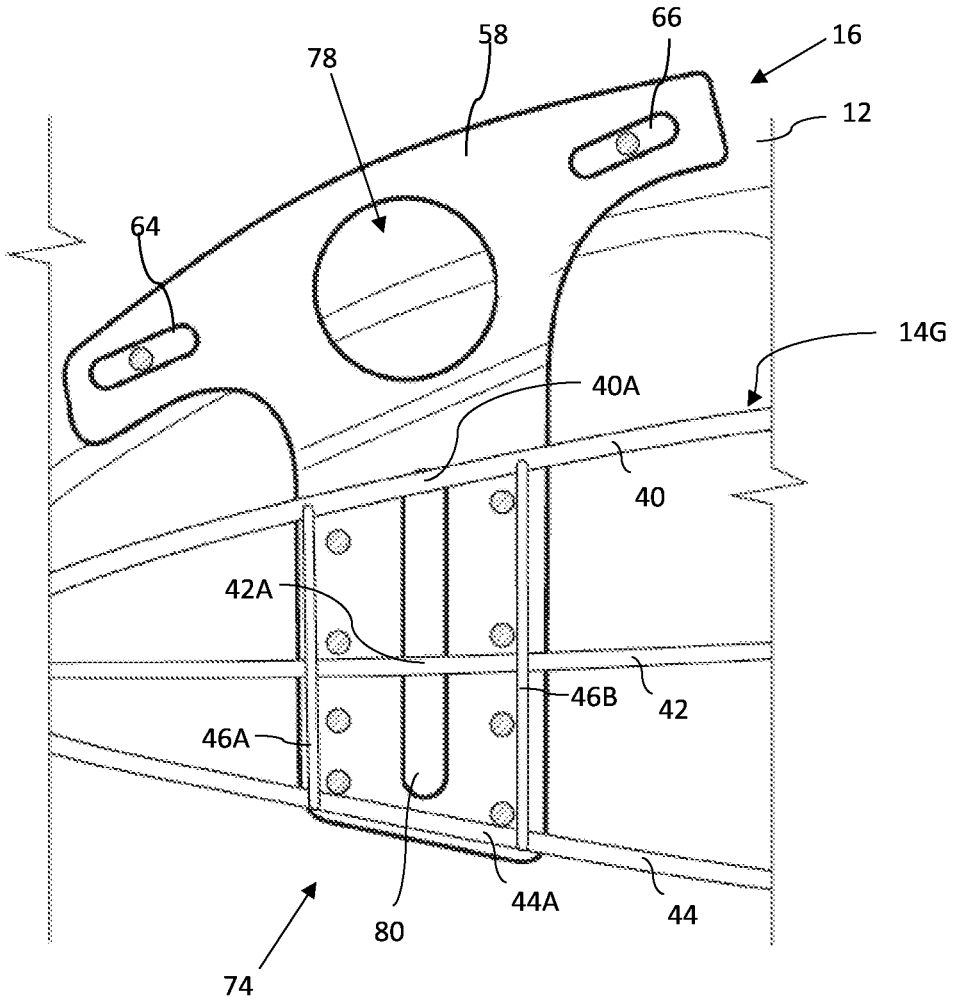
FIG. 3 shows an inner component of a side fastener arrangement which is used to secure a protective grille to a shell of the helmet.
Figure 4:
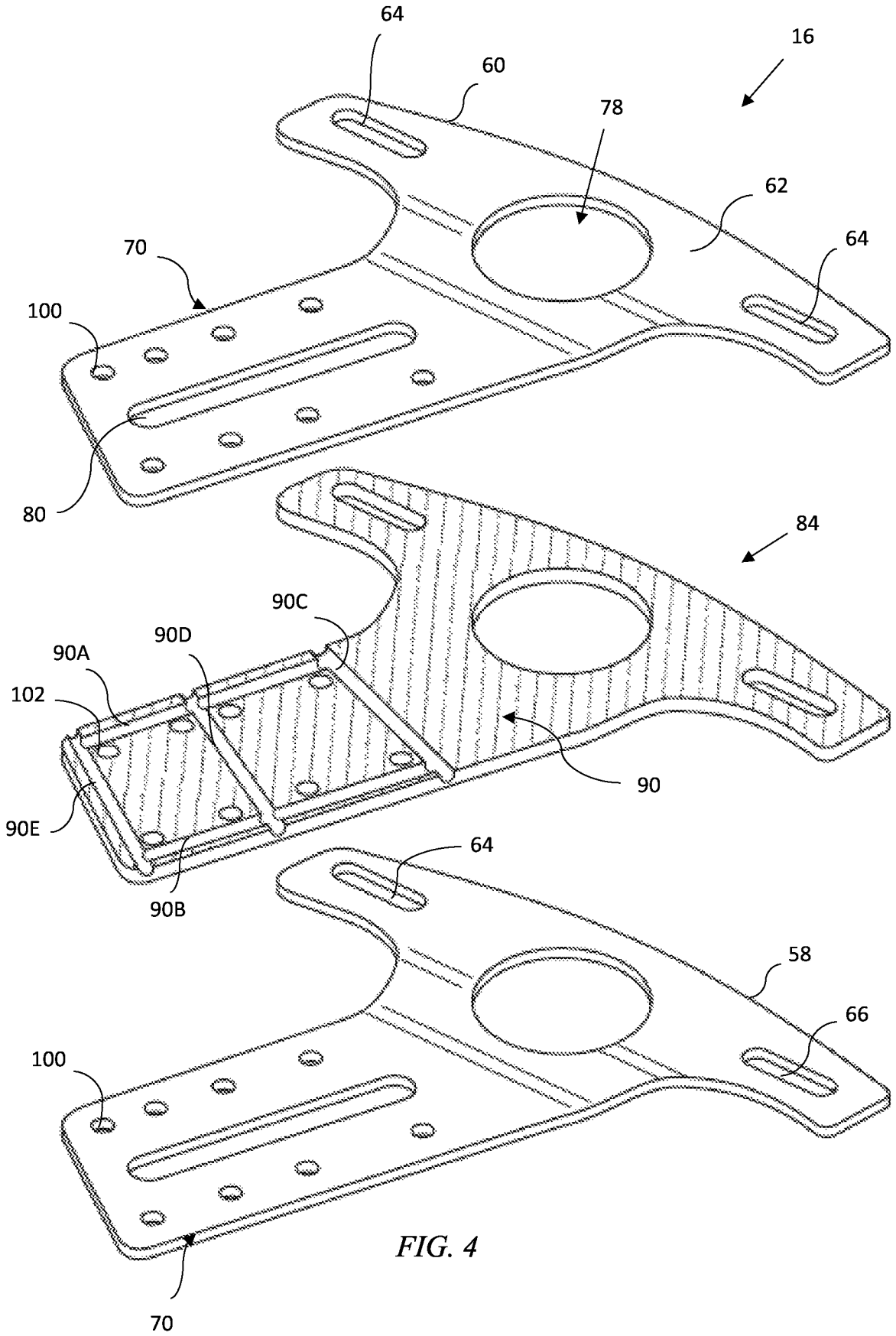
FIG. 4 is an exploded view in perspective of parts of the side fastener arrangement.

FIG. 3 illustrates a portion of the side fastener arrangement 16, a part of the helmet shell 12 and a part of the protective grille 14G. The side fastener arrangement 18 has a similar construction to the arrangement 16 and therefore is not further described herein. FIG. 4 shows the side fastener arrangement 16 in exploded perspective form—detached from the grille.

The side fastener arrangement 16 includes a first component 58 and a second component 60. The components 58 and 60 are substantially identical in outline and each comprises a respective stiff steel plate which has a cross piece 62 with spaced apart attachment holes 64 and 66.

An extension piece 70 projects downwardly (in use) from the cross piece 62. The extension piece 70 and an adjacent section 74 of the grille 14G are configured so that a portion 42A of the elongate member 42 is positioned more or less at a midpoint between adjacent portions 40A and 44A of the elongate members 40 and 44, and so that the extension piece 70 overlies adjacent spaced apart cross members 46A and 46B. The design is such that a hole 78 at a junction of the cross piece 62 and the extension piece 70 directly overlies an ear of a user (not shown).

An elongate slot 80 is formed in the extension piece 70.

Figure 5:
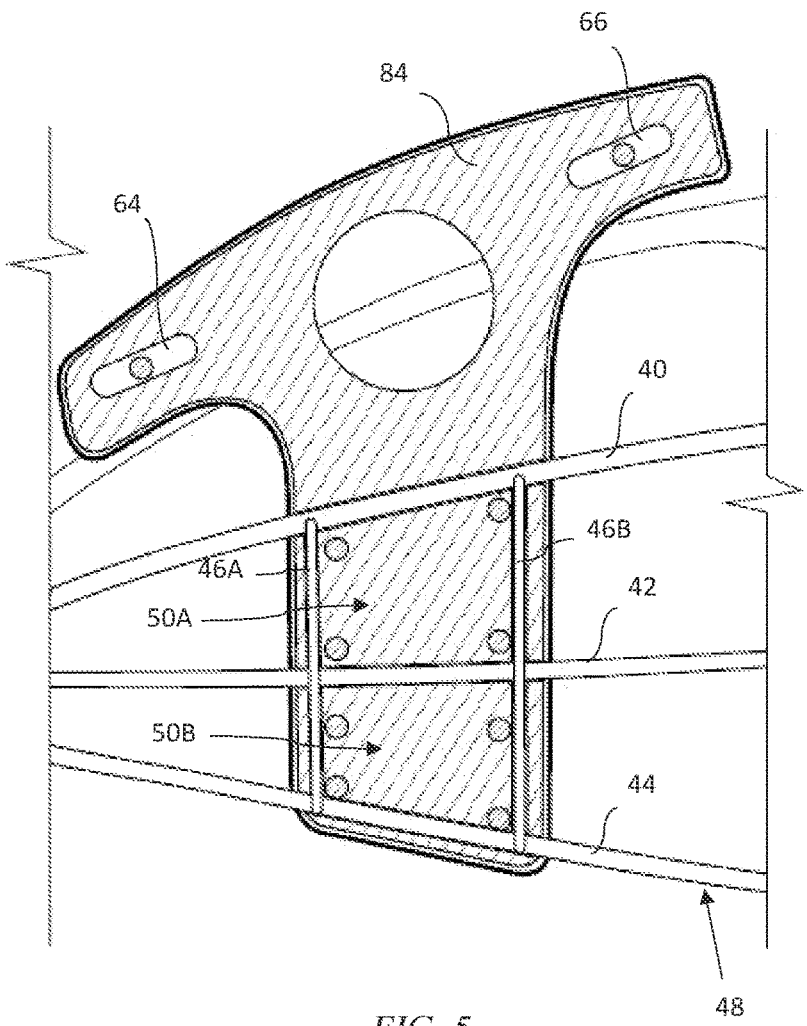
FIG. 5 is a side view of a shock absorbing element which is placed over a side of the inner component shown in FIG. 3.
Figure 6:
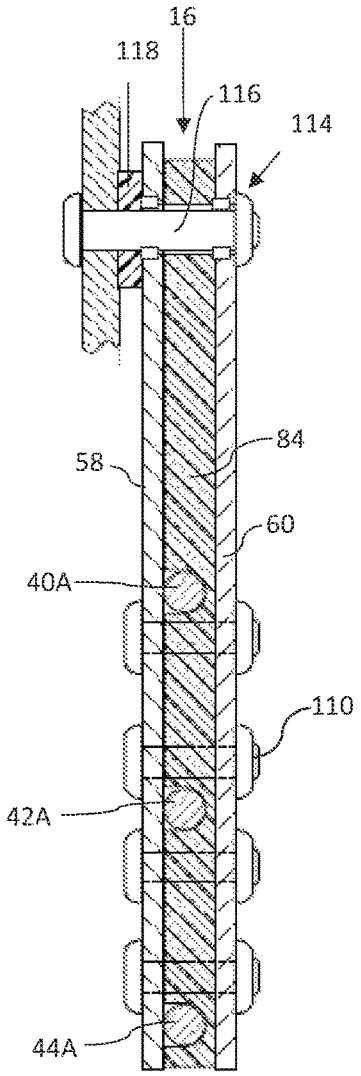
FIG. 6 is a view in cross section, taken on a line 6-6 in FIG. 1, of a side fastener arrangement on the helmet.

Referring to FIGS. 4, 5 and 6 the fastening arrangement 16 further includes a shock absorbing element 84.

The shock absorbing element 84 includes a body 90 which is made from a shock absorbing or resiliently deformable material such as a suitable grade of polyurethane or rubber. Preferably rubber with a Shore hardness of less than 50 is used. A suitable Shore hardness which has been found to be effective in absorbing impact shock is from 20 to 30.

The body 90 is sized so that, as is shown in FIG. 5, parts of the body 90 can be closely positioned inside two adjacent mesh apertures 50A and 50B respectively in the closed loop structure 48. Opposing grooves 90A and 90B are formed near respective generally linear edges of the body 90. These grooves are designed and positioned so that relevant parts of cross members 46A and 46B at opposite sides of the mesh apertures 50A and 50B can be located closely in the grooves. Additionally, the body is formed with transversely extending grooves 90C, 90D and 90E into which the portions 40A, 42A and 44A of the elongate members 40, 42 and 44, at respective edges of the mesh apertures 50A and 50B, can be located.

The component 60 overlies and is in contact with what, in use, is an outer side of the body 90. The component 60, the body 90 and the component 58 are formed with respective holes 100, 102, 100 which are in register when these parts are correctly assembled, and thereby form passages which receive respective fasteners 110. As each fastener 110 is put into position and tightened the body 90 is clamped between opposing surfaces of the components 58 and 60. The portion 42A of the elongate component 42 is positioned inside the groove 90D which goes from one edge of the body 90 to an opposing edge. Each fastener 110 is preferably a flush-fitting rivet, or the like.

The shock absorbing element 84 is sandwiched between the spaced apart but opposing steel plates which constitute the components 58 and 60. This is shown in FIG. 6. This laminated type of construction is strong and is able to resist direct impact forces from a high speed ball. The element 84 thus is engaged with an aperture and parts of the respective elongate and cross members which act as keying formations and vice versa.

The cross pieces 62 of the two components 58 and 60 are in register with each other and fasteners 114 are engaged with the attachment holes 64 and 66 and with holes in the helmet shell 16 thereby to secure the side fastener arrangement 16 to the helmet shell—see FIG. 6. Each fastener 114 is preferably "floating" in that it has a shank 116 which is surrounded by material of the shock absorbing element 84 and does not contact the component 58 nor the component 60. Additionally, a resilient bush 118 is located between the helmet shell and the inner component 58. This enables the interface between the helmet shell and the fastener arrangement 16 to be of a shock absorbing nature.

Figure 4A:
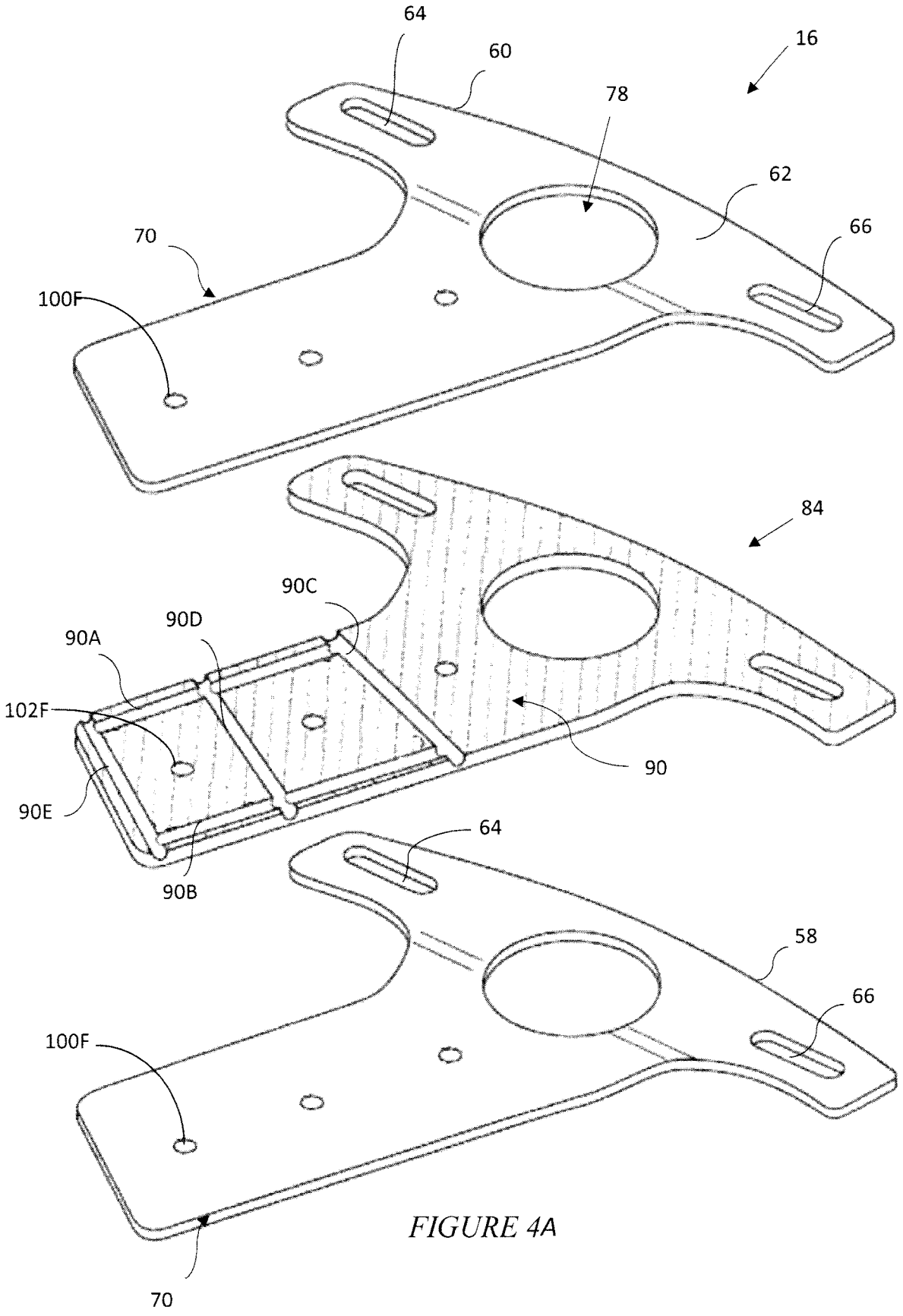
FIG. 4A shows a different form of the arrangement in FIG. 4.

FIG. 4A shows a modification of the FIG. 4 construction in that, in place of the four holes per aperture, a single hole 100F is made in each component 58, 60 and a single registering hole 102F in the body 90 for a single fastener (not shown—three in total), to achieve a laminate in which the body 90 is tightly clamped between the components 58 and 60 in a manner which is effectively non-slip, but which is capable of absorbing an impact shock by resiliently deforming the body 90.

Figure 2:
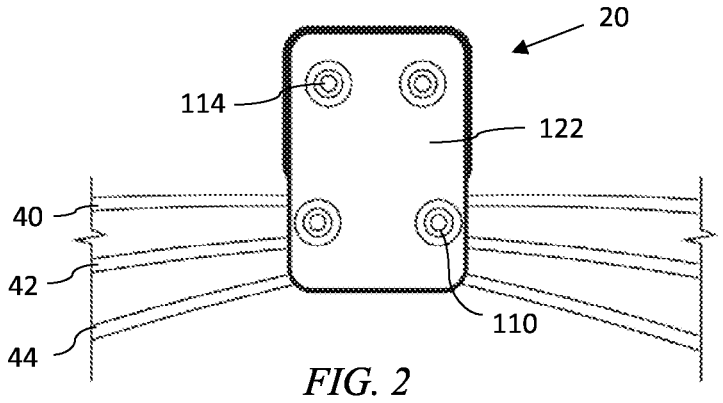
FIG. 2 shows a rear end of a part of the helmet of FIG. 1.
Figure 7:
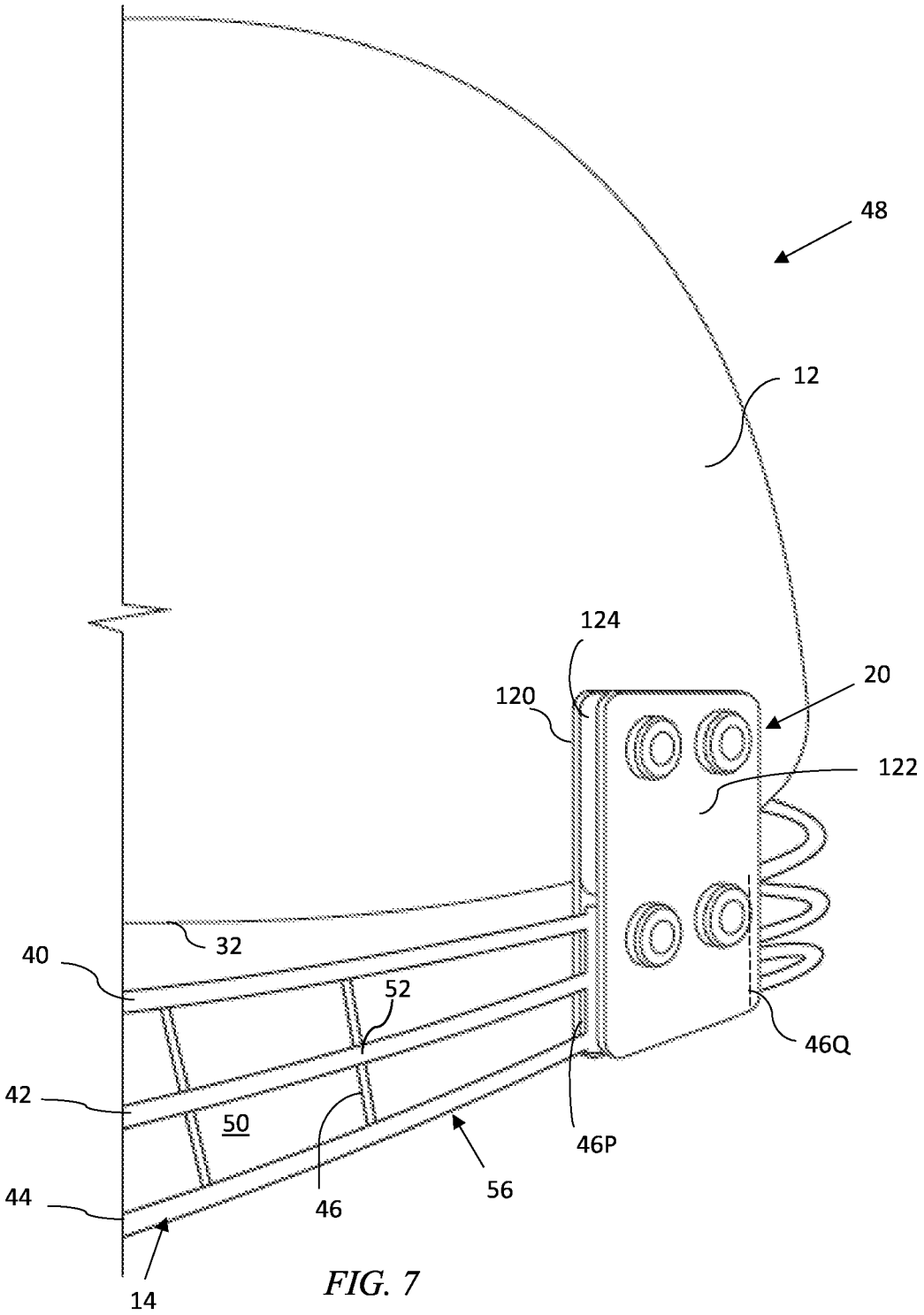
FIG. 7 is a perspective view of a fastening arrangement at a rear end of the helmet which is shown in FIG. 2, and FIGS. 8, 9 and 10 correspond respectively to FIGS. 1, 5 and 6 and illustrate a helmet according to another form of the invention.

Details of the rear fastening arrangement 20 are shown in FIG. 2 and in FIG. 7. In concept the fastening arrangement 20 is similar to the fastening arrangement 16 although the concept is embodied in a construction which is smaller, physically, than what is employed in each side fastening arrangement 16, 18.

The fastening arrangement 20 thus has an inner component 120 and an outer component 122 each of which is formed from a respective stiff steel plate, and a resiliently deformable shock absorbing element 124 which is between the components and which is formed with grooves which engage with corresponding sections of the elongate elements 40, 42 and 44 at the rear end of the helmet shell and with cross members 46P and 46Q which are transverse to and welded to the elongate members. The shock absorbing element 124 can be resiliently deformed but it is not capable of escaping from the closure which is formed by the parts referred to.

The shock absorbing arrangements 16, 18, 20 which fix the closed loop structure 48 of the protective grille 14G to the helmet shell 12 are lightweight and are configured not to obstruct the visibility of a wearer of the helmet nor to interfere with the transmission of sound to the ears of the user. If a ball should strike the protective grille 14G from practically any direction the shock absorbing elements in the respective fastening arrangements 16, 18, 20 are deformed to a greater or lesser extent depending on the force of impact of the ball. The degree of deformation is dependent at least on the physical size of each element and its hardness. As noted each element may be perforated or aerated to control a deformation vs force characteristic. Also, by forming an aperture in the components 58 and 60, such as the elongate slot 80, the clamping effect of the plates is reduced, and an opening is formed into which a part of the shock absorbing element can be forced, with an extruding-type action.

The protective shield is spaced from, and does not directly contact, the helmet shell. Shock forces are not transferred to the shell via the shock absorbing elements. For an application like cricket, the shell is preferably spaced from the lower edge of the helmet. However, depending on the application a part of the helmet, or the entire shell may extend above and below the lower edge—the invention is not limited in this respect.

The deformation process is accompanied by the transmission of force from a ball impacting on the protective grille, to the helmet shell 12, but this is through the intermediary of the shock absorbing, resiliently deformable, elements. The degree of force which is transmitted is thus reduced by the amount of force which is absorbed in the process of deforming the shock absorbing element. The helmet shell 12, in turn, is engaged with a user's head via an intermediate shock absorbing liner inside the helmet shell. Thus, although the transmission of force to the user's head is not eliminated, the magnitude of the force which is so transmitted is much reduced.

Upon impact the shock absorbing element remains connected in a non-slip manner to the grille due to the keying formations which are engaged with the element. The element can however deform under the impact and in this way help to absorb the shock and so provide protection for the wearer of the helmet.

The closed loop structure 48 provides all-round protection against impact, say from a ball, for the head and neck of a user. Impact force on the closed loop structure 48 is transmitted in what may be referred to as a "circumferential" manner by the looped elongate members 40, 42 and 44 and, consequently, each fastening arrangement 16, 18, 20 is capable of absorbing some of the impact force via the respective shock absorbing elements. In each fastening arrangement 16, 18, 20 the spaced apart plates and the intermediate shock absorbing element provide a laminated form of structure which is resistant to bending and which thus provides protection against direct side impact. Nonetheless via the intermediate shock absorbing element between the plates forces on the closed loop structure 48 are dispersed circumferentially and absorbed in the manner which has been described.

Figure 8:
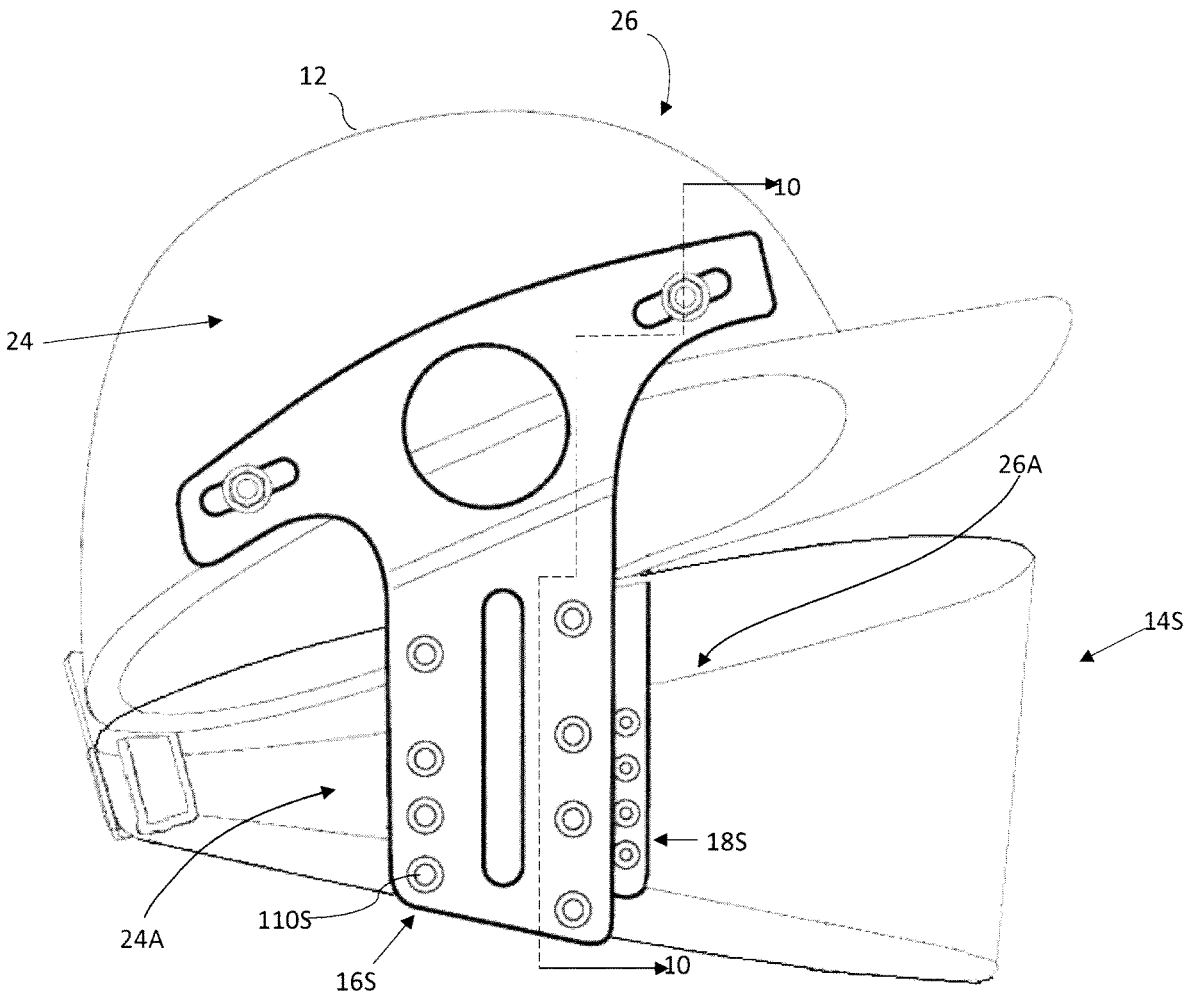
Figure 9:
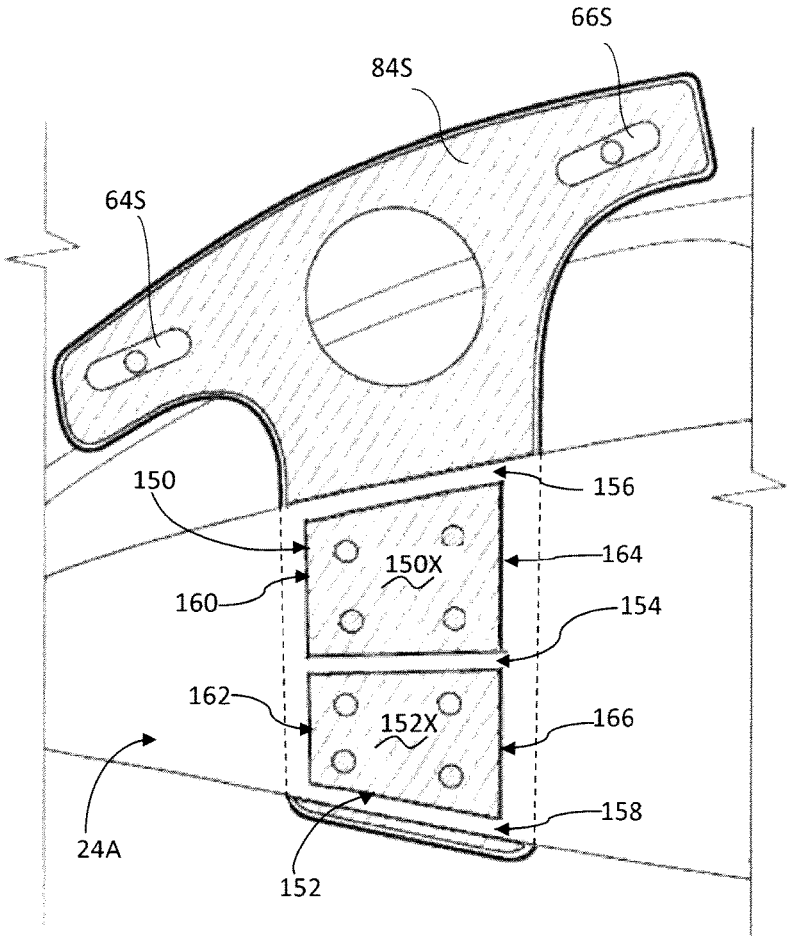
Figure 10:
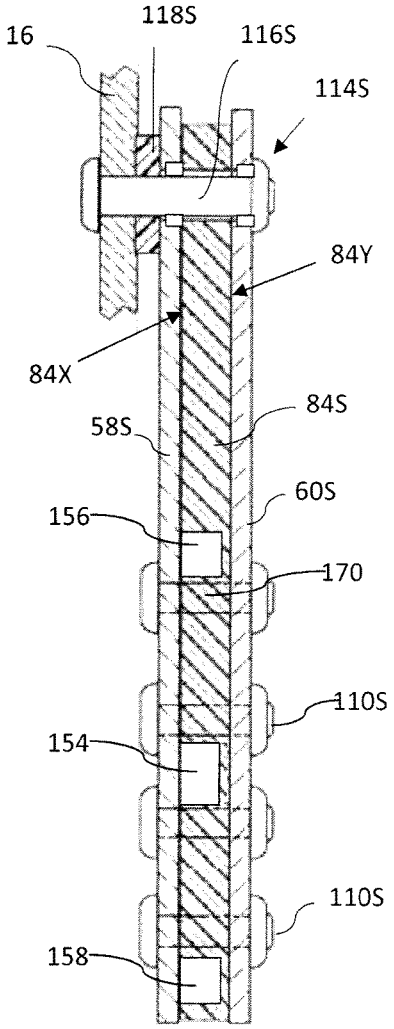

FIGS. 8 to 10 correspond to FIGS. 1, 5 and 6 respectively but illustrate an arrangement in which the protective shield 14 is modified in that the protective grille 14G is replaced by a protective sheet material 14S. The sheet material 14S (by way of example only) follows the outline of the grille 14G and also forms a closed loop structure. The sheet material comprises a tough plastics material which is impact and shock resistant.

The principles outlined in connection with FIGS. 1 to 7 apply to the configuration shown in FIGS. 8 to 10. For this reason like reference numerals with the suffix S are used to designate like components. However the protective sheet material is formed on each of two opposing sides 24A and 26A, respectively adjacent the sides 24 and 26 of the helmet shell 12, with keying formations which, in this example, are in the form of apertures 150 and 152 respectively which broadly correspond to the mesh apertures 50A and 50B shown in FIG. 5. A solid strip 154 of the sheet material is between the two apertures 150 and 152 which are flanked above and below by solid strips 156 and 158 of the sheet material and on the sides by edges 160, 162, 164 and 166 of the sheet material.

FIG. 9 illustrates one side of the arrangement—a similar configuration is adopted on the opposing side.

The shock absorbing element 84S is configured so that portions 150X and 152X thereof occupy the apertures 150 and 152 and so that outer surfaces 84X and 84Y of the element 84S closely contact opposing inner surfaces of the components 58S and 60S. Fasteners 110S pass through registering holes in the components 58S and 60S and in the shock absorbing element 84S. Shanks 170 of the fasteners 110S are floating in that they are spaced from sides of the strips 154, 156 and 158, and from sides of the edges 160, 162, 164 and 166. The sheet material, under impact, can thus move as the material of the shock absorbing element is deformed between each shank and an opposing surface of the sheet material. Thus if the shield 14 is impacted by a ball or other object the shock absorbing material 84S sandwiched between the components 58S and 60S can deform and absorb a substantial part of the shock. Impact loading is also transferred, as appropriate, to the rear end of the helmet which is configured in a similar way to what has been shown in FIG. 9.

Alternatively or additionally to the apertures 150, 152 in the sheet material, keying formations of a different kind e.g. projections can be formed in or fixed to the sheet material—the element 84S is then formed with formations of a complementary shape to the keying formations so that engagement of the element 84S with the sheet material 14S is effected in a non-slip, yet resiliently deformable, shock-absorbing manner.

The laminated structure of each fastening arrangement 16S, 18S absorbs shock loading in the manner described and also transfers loading to the helmet shell through the intermediary of the associated shock absorbing attachments 118S and fasteners 114S.

The invention claimed is:

1. A helmet comprising:

a helmet shell having opposed first and second sides, a front end, a rear end and a lower edge, a protective shield having a closed loop structure surrounding the helmet shell and having a radial inner side, a radial outer side and keying formations in or on the protective shield, and first and second side fastening arrangements which respectively secure the protective shield to the first and second sides of the helmet shell, each side fastening arrangement respectively having first and second spaced apart components located respectively on said radial inner side of the closed loop structure and on said radial outer side of the closed loop structure, at least one resiliently deformable shock absorbing element engaged with at least one of said keying formations and located between said first and second components, and at least one fixing member engaged with the first and second components and which urges the first and second components towards each other with the at least one resiliently deformable shock absorbing element clamped between opposing surfaces of the first and second components, and with the first component opposing an outer surface of a respective side of the helmet shell.

2. The helmet according to claim 1, wherein the protective shield comprises a protective grill formed from a plurality of elongate members and a plurality of cross members respectively secured to the elongate members at spaced apart locations thereby forming a plurality of apertures which include at least some of said keying formations, and wherein each of the at least one resiliently deformable shock absorbing element is located at least partly within a respective aperture bounded by opposed portions of two of the elongate members and opposed portions of two of the cross members and is sandwiched between opposing surfaces of the first and second components.

3. The helmet according to claim 1, wherein the protective shield comprises a protective sheet material in or on which is formed said keying formations with which each of the at least one resiliently deformable shock absorbing element is engaged.

4. The helmet according to claim 1, wherein each of said first and second components comprises a respective plate.

5. The helmet according to claim 1, wherein each of the at least one resiliently deformable shock absorbing element comprises a body made from rubber.

6. The helmet according to claim 1, wherein each fixing member extends through the at least one resiliently deformable shock absorbing element and is mounted in a floating state such that it abuts the at least one resiliently deformable shock absorbing element and does not directly contact the protective shield.

7. The helmet according to claim 1, wherein the protective shield is spaced from and opposes the lower edge of the helmet shell.

8. The helmet according to claim 1 wherein each of said side fastening arrangements respectively includes a resilient bush between the first component and the said outer surface of the respective side of the helmet shell.

9. The helmet according to claim 1 wherein, in respect of each side fastening arrangement, the first and second components are substantially identical in outline and each respectively includes a cross piece and an extension piece which, in use, projects downwardly from the cross piece.

10. The helmet according to claim 9 wherein each side fastening arrangement is secured to the helmet shell at least at two spaced apart locations on the cross pieces which are in register with each other.

11. The helmet according to claim 9 which includes a plurality of said fixing members at spaced apart locations on said extension pieces.

12. The helmet according to claim 1 wherein the side fastening arrangements are configured so that the protective shield is spaced from and does not directly contact the helmet shell.

13. The helmet according to claim 2 further comprising a rear fastening arrangement for securing the protective grill to the helmet shell, the rear fastening arrangement comprising an inner component, an outer component, another resiliently deformable shock absorbing element between the inner component and the outer component and being formed with grooves which engage with sections of the elongate elements and of the cross members, and fasteners fixing the inner component, the outer component and the another resiliently deformable shock absorbing element to the rear end of the helmet shell and to the protective grill which is spaced from the lower edge of the helmet shell.

* * * * *